United States Patent [19]

Vits

[11] Patent Number: 5,060,928

[45] Date of Patent: Oct. 29, 1991

[54] APPARATUS FOR THE DEPOSITING OF SHEETS AT A STACKING LOCATION

[76] Inventor: Hilmar Vits, Hüschelrath 16, 5653 Leichlingen, Fed. Rep. of Germany

[21] Appl. No.: 388,781

[22] Filed: Aug. 2, 1989

[30] Foreign Application Priority Data

Aug. 3, 1988 [DE] Fed. Rep. of Germany ..... 3826292
Jun. 22, 1989 [DE] Fed. Rep. of Germany ..... 3920407

[51] Int. Cl.[5] ..... B65H 29/68

[52] U.S. Cl. ..... 271/182; 271/188; 271/194; 271/209

[58] Field of Search ..... 271/182, 183, 194, 195, 271/209, 188

[56] References Cited

U.S. PATENT DOCUMENTS

| | | | |
|---|---|---|---|
| 3,727,911 | 4/1973 | Vits | 271/195 |
| 3,941,374 | 3/1976 | Vits | 271/183 |
| 3,945,634 | 3/1976 | Calvert | 271/209 X |
| 4,019,731 | 4/1977 | Vits | 271/183 |
| 4,062,536 | 12/1977 | Michelson | 271/209 X |
| 4,221,377 | 9/1980 | Bodewein | 271/183 |
| 4,247,094 | 1/1981 | Vits | 271/183 |
| 4,346,881 | 8/1982 | Frye | 271/188 X |
| 4,625,956 | 12/1986 | Marass | 271/183 |
| 4,667,949 | 5/1987 | Goodwin | 271/109 X |
| 4,824,092 | 4/1989 | Kriefall | 271/183 |

*Primary Examiner*—Richard A. Schacher
*Attorney, Agent, or Firm*—Sprung Horn Kramer & Woods

[57] ABSTRACT

The invention relates to an apparatus for the depositing of sheets at a stacking location. The apparatus has an overhead suspension arrangement 15 which is fed with blasted air and extends some way over the stacking location 2, 3. This overhead suspension arrangement 15 has an undulating profile, extending in conveying direction, which imposes on the conveyed sheet to be deposited an undulation improving its dimensional rigidity, so that it can no longer buckle or turn on striking the stop. To reduce the conveying speed of the sheets, the stacking location is preceded by an overlapping station 9, 10, which initiates the braking operation a great distance ahead of the stacking location 2, 3 and keeps the sheet at braked speed almost until the striking of the sheet against the stop 6 without the overlapping being hindered by this.

10 Claims, 5 Drawing Sheets

APPARATUS FOR THE DEPOSITING OF SHEETS AT A STACKING LOCATION

Figure 1:
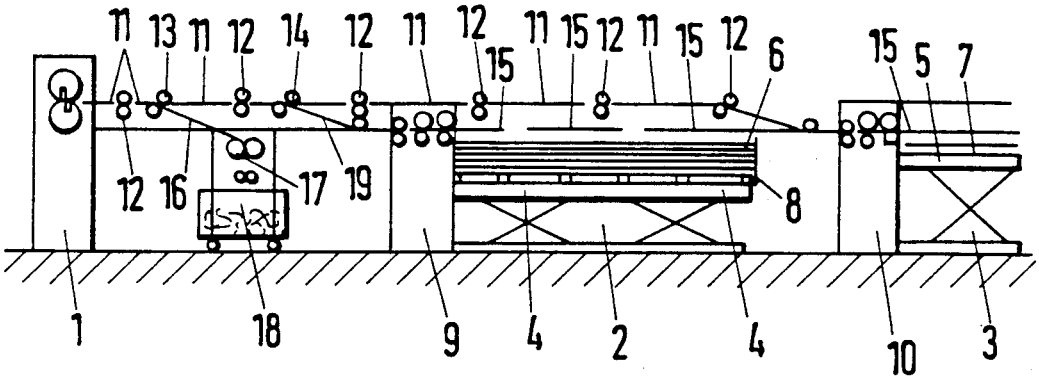

The invention relates to an apparatus for the depositing of sheets at a stacking location which is provided with a stop for the leading sheet edge and consists of conveying means having an overhead suspension arrangement, which is fed with blasted air and extends over the stacking location, and an overlapping station, which precedes the stacking location and has a deflecting member, arranged above the conveying plane of the sheets and acting on the sheet ends in time with the sheet sequence, and a braking and conveying member, arranged underneath the conveying plane of the sheets and acting on the deflected sheets.

In the depositing of sheets at a stacking location, various precautions are taken in order that the sheets striking the stop are not buckled. In the case of sheets which have a low material rigidity and are conveyed at high conveying speed to the stacking location, there is the risk that disturbances may occur in the depositing due to buckles. Therefore, in all known apparatuses for the depositing of sheets, the stacking location is preceded by an overlapping station with a braking member, which is intended to reduce the conveying speed of the incoming sheets to an uncritical value. Whenever the sheets are conveyed in close succession, a reduction in the conveying speed can only be achieved if the sheets can overlap during braking. Therefore, the braking member in the depositing of sheets is part of the overlapping station, the deflecting member of which presses the sheet ends down out of the conveying plane, so that the end of a sheet deflected out of the conveying plane can have the beginning of the next following sheet in the conveying plane pushed over it. With the combination of deflecting member and braking member in the overlapping station, in practice great advances could be achieved in troublefree sheet depositing at high conveying capacities. At the same time, a still unresolved problem is that a retarded sheet whose trailing edge leaves the braking member is accelerated once again because both the overhead suspension arrangement and the sheet still sliding over it at full speed act in a propelling way on it by friction. (DE 2348320 C3; DE 2841658 B1).

The invention is based on the object of creating an apparatus for the depositing of sheets at a stacking location in which a buckling of the sheets, in particular a resultant damage to flimsy sheets at the stop of the stacking location does not occur.

This object is achieved in the case of an apparatus of the type mentioned at the beginning by the overhead suspension arrangement having in the region of the stacking location an undulating profile running in conveying direction.

The sheets striking the stop with their leading edge cannot buckle because they hug the undulating shape of the overhead suspension arrangement and, due to their adopted undulating shape, have been given a high dimensional rigidity. The previously uncontrollable renewed accelerating of the retarded sheet, responsible for buckling and damaging, can therefore no longer act adversely. It goes without saying that the overlapping station preceding the stacking location must be designed such that, while taking into account the conveying speed of the incoming sheets and their material rigidity, it reduces the conveying speed of the sheets in such a way that the remaining impact forces against the $top of the stacking location can be withstood due to the undulating profile of the sheet imposed on the sheet in the region of the stacking location. Whenever the conveying speed is in any case low, a conveying member of the overlapping station may even be dispensed with.

According to a preferred development of the invention, the height of the undulating profile increases from the rear stack edge to the stop at the front stack edge. This development makes allowance for the fact that a sheet cannot be profiled instantaneously and that, due to the increase in buckling forces towards the front stack edge, a greater dimensional rigidity is necessary towards the front stack edge. The increase in the height of the imposed undulating profile does not require a continuous increase in the height of the undulating profile of the overhead suspension arrangement. It can be achieved by a staged increase in the height of the undulating profile. The sheet itself then creates the compensation for a gradual increase.

The overhead suspension arrangement can be constructionally realized in a variety of ways. It is preferably formed by suspension bars arranged adjacently and extending in conveying direction, the side of which facing the conveying plane is concavely and/or convexly curved. However, it is also possible that the flat sides facing the conveying plane are offset angularly with respect to one another for the formation of the undulating profile.

The formation of the undulating profile on the sheets may already take place in the region of the overlapping station. According to a development of the invention, the braking member is a rotating roller which has an undulating profile corresponding to the undulating profile of the overhead suspension arrangement.

In order, on the one hand, to bring the sheet end safely into the effective range of the braking member and, on the other hand, to clear the way quickly for the beginning of the following sheet, without exerting an entraining effect on the sheet end in conveying direction with the deflecting member, according to a development of the invention, the conveying member is a rotating shaft fitted with brush segments. In this arrangement, the brush segments are spaced axially apart and can extend between the suspension bars of the overhead suspension arrangement. The suspension bars ensure that the sheet beginning is conveyed continuously in suspension. With this design of the brush segments, the roller of the braking member should be fitted with brake discs arranged at the same axial distance apart as the shaft with the brush segments, between which suspension bars of a su$pension table fed with blasted air extend. It is ensured by the suspension table that the deflected sheet end is also continuously guided.

The difficulty of introducing the braking operation with overlap at as early a time as possible and of further conveying the sheet slowly enough until the following sheet is braked is overcome according to a development of the invention by there being arranged immediately ahead of the stacking location a conveying member which has at least one rotating conveying roller, against which the deflected sheet is drawn by suction force. In order that the conveying member can be effective evenly over the width of the sheet and supports the braking, according to a further development it is provided that the conveying member is also activated by a second deflecting member above the conveying plane of the sheets, acting on the sheet in time with the sheet sequence. The circumferential speeds of the braking member and of the conveying member are the same and are adapted to the sheet length such that when one sheet is retarded, the conveyed sheet retarded before it has just left the conveying member.

To come as close as possible to the stacking location, in order that the freely led path of the sheet when it leaves this conveying member is as small as possible, the rollers of the conveying member consist of small pieces coupled in alignment, which are arranged immediately ahead of the stacking location in a suction box.

Figure 2:
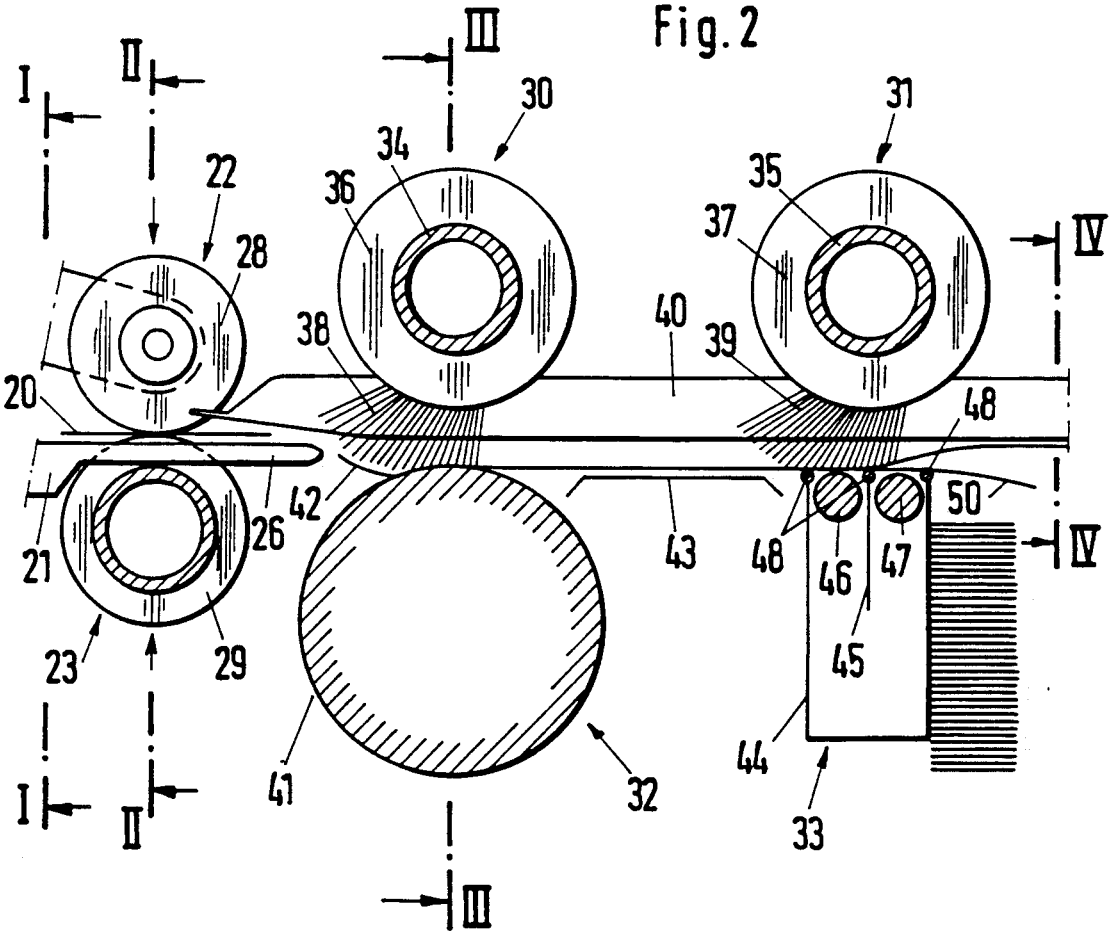
Figure 3:
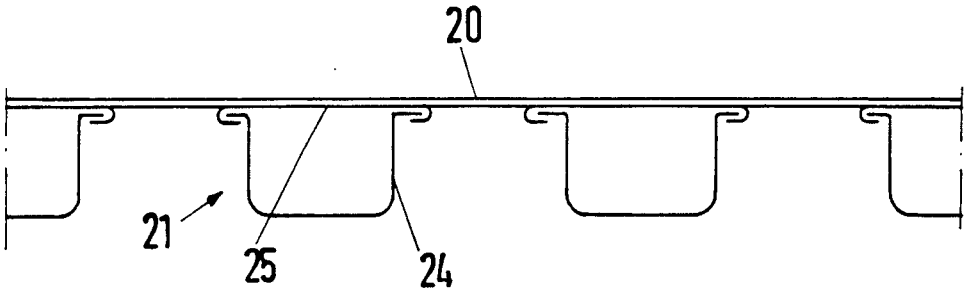
Figure 4:
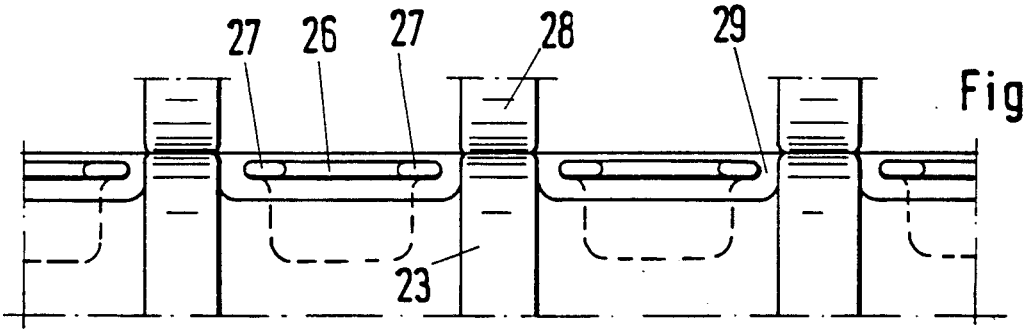
Figure 5:
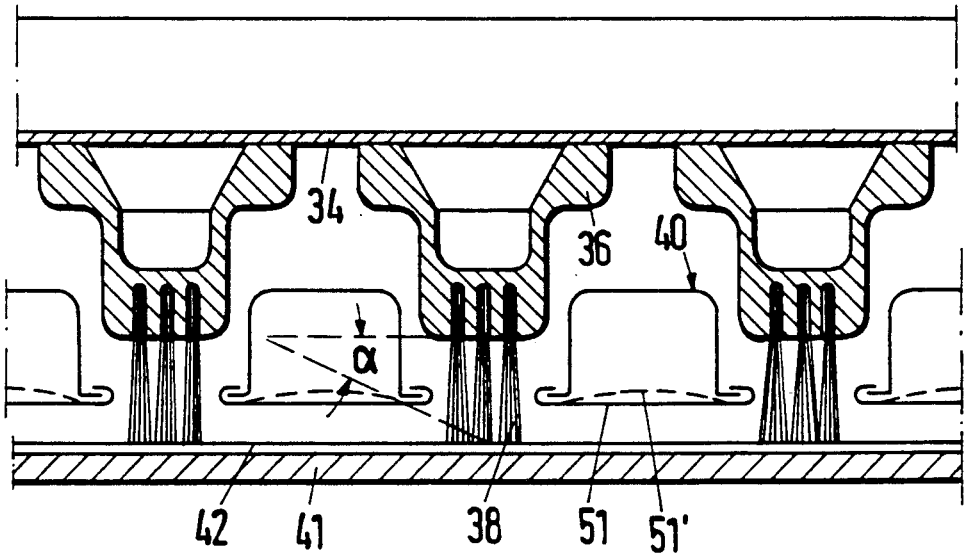
Figure 6:
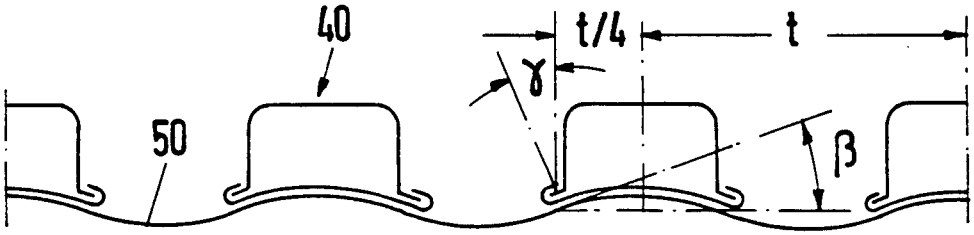
Figure 7:
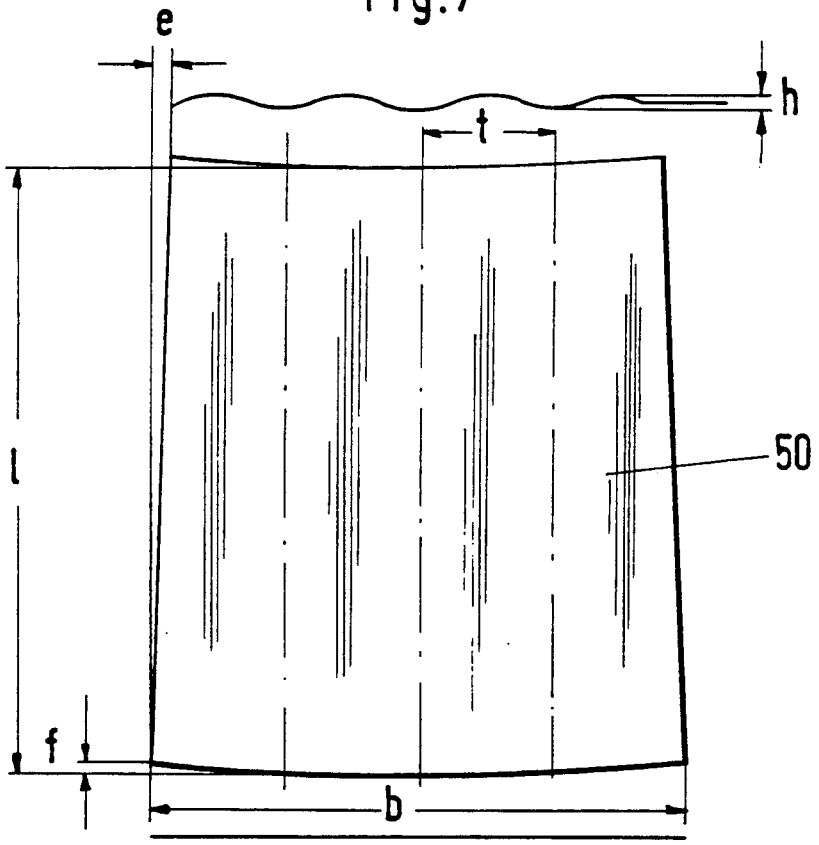
Figure 8:
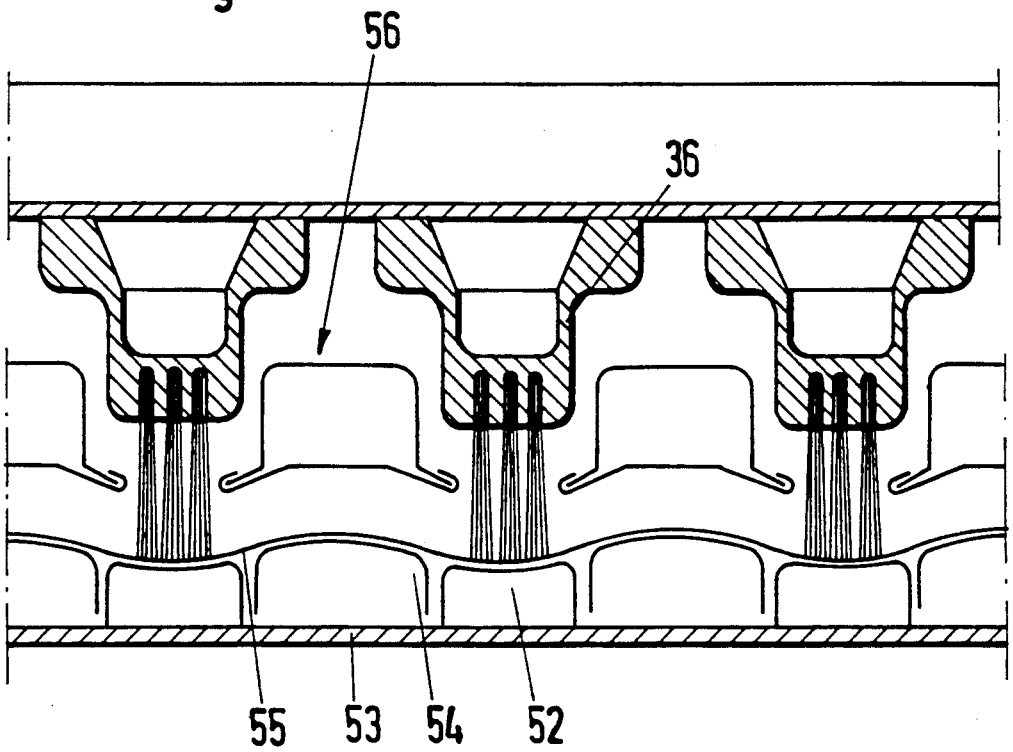
Figure 10:
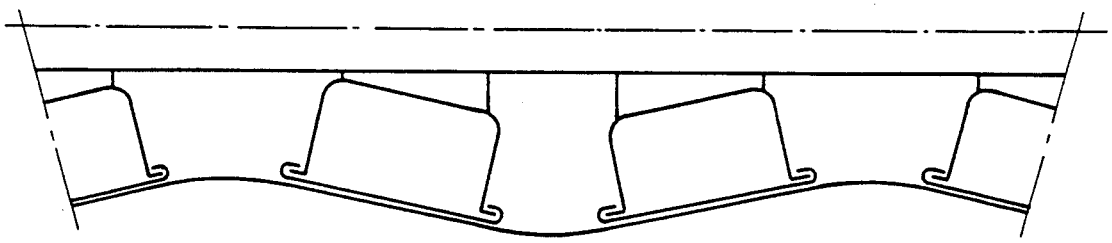
Figure 11:
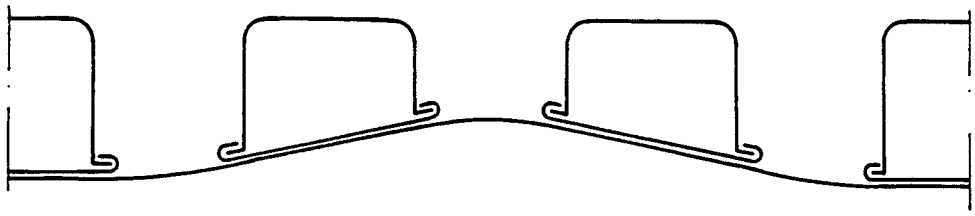
Figure 12:
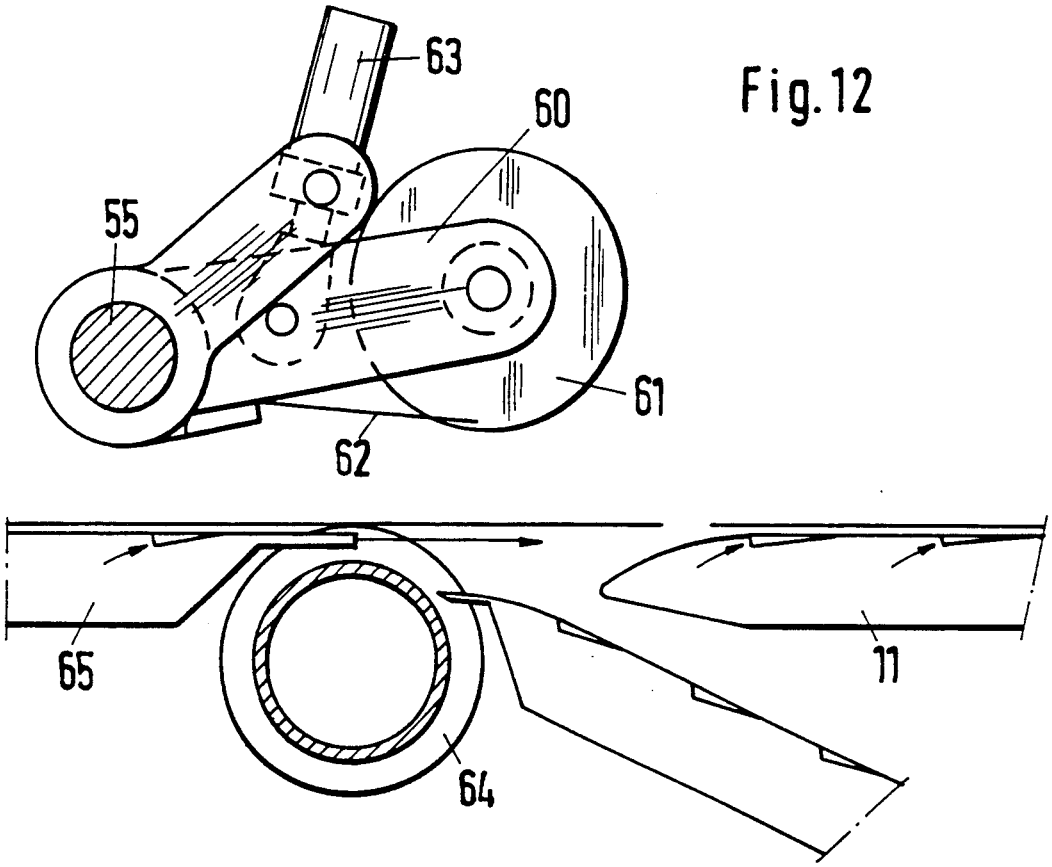
Figure 13:
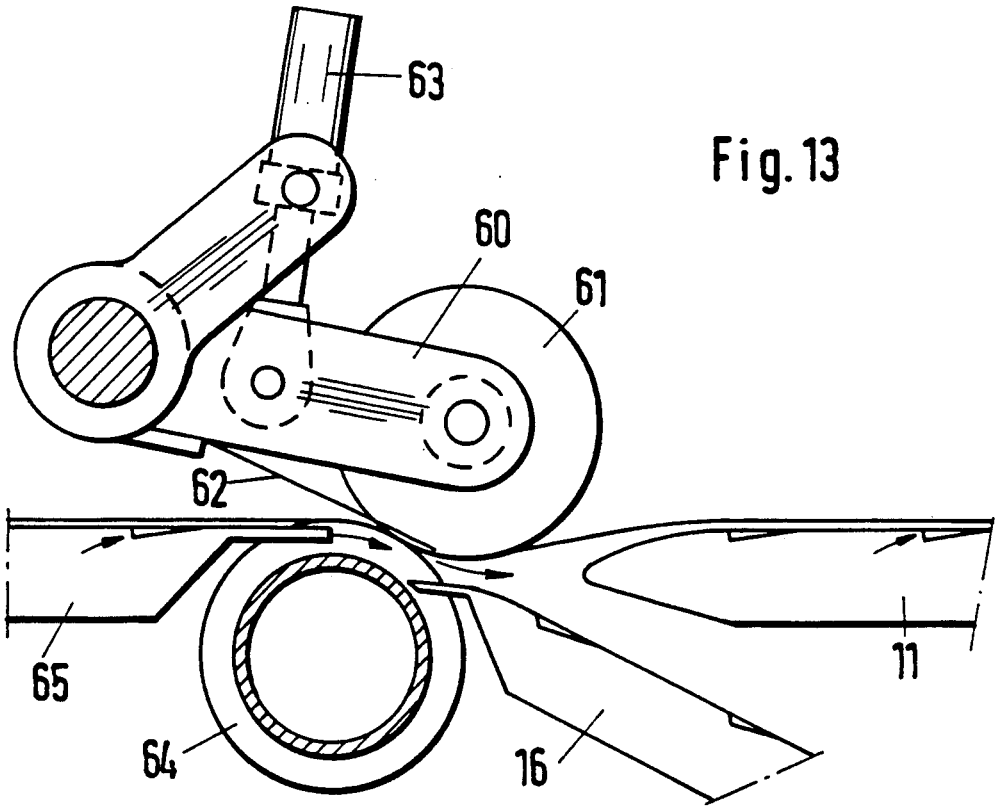

The invention is explained in more detail below with reference to a drawing representing an exemplary embodiment, in which:

FIG. 1 shows an apparatus for the depositing of sheets cut in a cross cutter at two stacking locations arranged one behind the other, in diagrammatic representation in side view, FIG. 2 shows an overlapping station of the apparatus according to FIG. 1, arranged ahead of a stacking location, in side view, FIG. 3 shows a suspension table of the apparatus according to FIG. 1 in the section I—I of FIG. 2, FIG. 4 shows a conveying means with a suspension table of the apparatus according to FIG. 1 in a cross-section along line II—II of FIG. 2, FIG. 5 shows the overlapping station of the apparatus according to FIG. 1 in section along the line III—III of FIG. 2, FIG. 6 shows an overhead suspension arrangement of the apparatus according to FIG. 1 over a stacking location in section along the line IV—IV of FIG. 2, FIG. 7 shows a sheet in the region of the depositing location, at the top in cross-section at its leading edge, in the middle in plan view and at the bottom in cross-section at its trailing edge, FIG. 8 shows the overlapping station of the apparatus according to FIG. 1 in section along the line III—III of FIG. 2 in an alternative design to FIG. 5, FIGS. 9 to 11 show overhead suspension arrangements in a cross-section in alternative designs to FIG. 6, FIGS. 12 and 13 show a switch of the apparatus according to FIG. 1 in two alternative functional positions, in side view.

The apparatus shown in FIG. 1 for the depositing of sheets has a cross cutter 1, with which a fed web of material is cut into individual sheets, and two stacking locations 2, 3 each with a raisable and lowerable table 4, 5, on which the incoming sheets can be deposited as stacks 6, 7. At the front edge of each stacking location 2, 3 there is arranged a stop 8, against which the sheets to be deposited strike hard with their leading edge. Each stacking location 2, 3 is preceded, furthermore, by an overlapping station 9, 10, with which the sheets arriving at high conveying speed are overlapped and retarded to a low speed suitable for the depositing and further conveyed.

For the conveying of the sheets coming from the cross cutter 1, suspension tables 11 fed with blasted air and pairs of conveying rollers 12 are provided in an upper conveying plane. The suspension tables 11 consist, for example, of suspension bars known per se (DT 1907083 B2), between which the conveying rollers 12 are arranged. The conveying rollers 12 clamp the sheet to be conveyed between them and thus determine its conveying speed. With two switches 13, 14, a sheet can be deflected downwards out of the upper conveying plane. From the first switch 13 in conveying direction, a sheet is directed over a suspension table 15 to a shredder 17, under which a container 18 is ready to receive the shredded sheet. From the second switch 14 in conveying direction, a sheet is conveyed over a suspension table 19 into a lower plane to the overlapping station 9. Sheets which are not deflected by the switches 13, 14 pass on to the second overlapping station 10. In the region of both stacking locations 2, 3, the sheets leaving the overlapping stations 9, 10 are conveyed in suspension by overhead suspension arrangements 15. These overhead suspension arrangements 15 may, like the suspension tables 11, consist of individual suspension bars arranged parallel to one another and fed with blasted air, as are known from DT 19 07 083 B2.

While reject sheets are fed by the switch 13 downwards over a suspension table 16 to the shredder with collecting container arranged underneath, satisfactory sheets pass via the switch 14 to the overlapping station 9 and from here to the stacking location 2 or go through the switch 14 undeflected and pass via the overlapping and braking station 10 to the stacking location 3. The overlapping and braking stations 9, 10 have the same design.

Such an overlapping station is shown enlarged in FIG. 2. A sheet 20 to be deposited is fed by a suspension table 21 and a pair of conveying rollers 22, 23 at defined speed to the first overlapping station 9 in conveying direction. The conveying table 21 consists of a plurality of suspension bars, arranged parallel to one another, as are shown in detail in FIG. 3. Each suspension bar is made up of a hat-shaped profile 24 and of a flat cover plate 25, in which the blasting nozzles are formed. The blasting nozzles end in conveying direction at the front in a flat part 26, which has two blasting nozzles 27 at its tip. The conveying rollers 22 are arranged in alignment at an axial distance apart and press against discs 28 of the conveying roller 23 annular grooves 29 arranged between the discs, through which grooves the flat front parts 26 of the suspension bars protrude. These flat front parts 26 overlap with suspension bars, arranged above the conveying plane, of the suspension table 15 extending some way over the stacking location 3.

The overlapping station 9 has above the conveying plane two similar deflecting members 30, 31, spaced apart in conveying direction, which each act on a braking member 32 and conveying member 33 arranged underneath the conveying plane. The deflecting members 30, 31 consist of discs 36, 37 which are spaced axially apart on a driven shaft 34, 35 and are fitted with segment-like brushes 38, 39. Extending between these discs 36, 37 are the suspension bars 40 of the overhead suspension arrangement 15.

The braking member 32 assigned to the first deflecting member 30 in conveying direction consists of a drum with cylindrical jacket 41, the surface of which has a high coefficient of friction. The end of the sheet 42 to be retarded is pressed by the brush 38 against this jacket 41. Between the first braking member 32 and the conveying member 33 there is provided a transfer plate 43 for the support of the deflected sheet 42. The conveying member 33 consists of a suction box 44 with a central partition 45 and small conveying rollers 46, 47 arranged on both sides of the partition 45. These conveying rollers 46, 47 are provided with a covering having a high coefficient of friction, and their speed is equal to the speed of the drum of the braking member 32. The upper edges 48 of the partition 45 and of the walls of the suction box 44 are rounded off and provided with a covering with sliding properties. The partial vacuum in the suction box 44 causes the deflected sheet 42 to be drawn against the conveying rollers 46, 47. Since the suction box 44 bears with one side wall immediately against the stack, the conveying member 33 can maintain its conveying action virtually up to the striking of the leading sheet edge against the stop 8. The distance between braking unit 30, 32 and conveying units 31, 33 is chosen such that, at the beginning of the overlapping operation, the brushes 38 have not yet fully brushed over the braking member 37 if the sheet 50 to be deposited previously has not yet fully left the conveying member 37. In the case of large-format sheets, the length of which is substantially greater than the brush path of one revolution, the deflecting members 30, 31 are raisable and lowerable.

According to the exemplary embodiment of FIG. 4, the suspension bars 40 of the suspension table 15 are still flat in the region of the overlapping and braking station 9 on their side facing the sheet 42. The plate 51, still flat here and having the blasted-air nozzles, then goes over however into a section 51' of concave profile, which has at its edge an angle $\alpha$. The wave height h should be in the range from 5 to 15% of the pitch t. The angle $\alpha$ should in this case lie in the range of 10° and 30°. With sufficiently high suction forces of the blasting bars, the sheet 50 then adopts an undulation which gives it an adequate dimensional rigidity, with which there is no risk that it is buckled when striking the stop 8.

Figure 9:
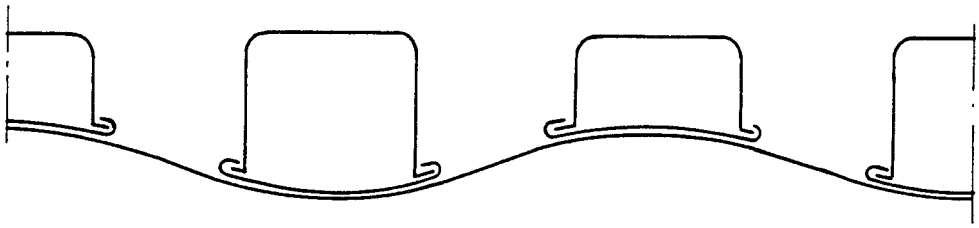

Various alternatives for the disposition of the overhead suspension arrangement 15 are shown in FIGS. 9 to 11. It is accomplished with each design that the sheet to be deposited has an undulating form at the end of the conveying path. In all cases, the height h should be dimensioned such that it increases in conveying direction. This makes allowance for the fact that the loading of the sheet increases towards the leading edge, because the effective mass always becomes greater in the conveying direction of the sheet.

This increasing waviness towards the leading edge is shown in FIG. 7. Since the sheet is not very flexible in its surface area, imparting the undulations can only be commenced when the sheet has left the last conveying rollers 22, 23 clamping it.

In FIG. 8, it is shown as an alternative to the design of FIG. 5 that the undulation can be commenced already at the first deflecting and braking unit. In this case, the continuously cylindrical braking member 32 of FIGS. 2 and 7 is replaced by a braking shaft 53 fitted with brake discs 52. Between the brake discs 52 there extend suspension bars 54 which are fed with blasted air and form a suspension table. The sides of the braking discs 52 and of the blasting bars 54 facing the sheet 55 to be retarded have an undulating profile. Above the blasting bars 54, blasting bars 56 are provided, the side of which facing the sheet 55 has an angularly recessed profile.

The switch shown in FIGS. 12 and 13 has deflection rollers 61, pivotally mounted on a swivel arm 60 and with baffles 62 arranged in the intermediate spaces. By means of a cylinder-piston arrangement 63, this unit can be brought out of the position shown in FIG. 12 into the position shown in FIG. 13. A lower conveying roller 64 with a preceding suspension table 65 corresponds essentially to the design of the conveying roller 23 and the suspension table 21 of FIG. 2. The blasted air discharged from the blasting nozzles at the tip of the suspension table 65 favours straight-ahead transport when the deflecting roller 61 is not swung down, because the blasted air jet then carries the sheet, as shown in FIG. 12. With the deflecting roller swung down, the blasted jet is also deflected downwards by the baffle 62 and favours the deflection of the sheet beginning onto the lower suspension table 16.

I claim:

1. In an apparatus for the depositing of sheets at a stacking location (at least one of 2 and 3) which is provided with a stop (6) for the leading sheet edge, and which consists of conveying means (11, 12) having an overhead suspension arrangement (15), which is fed with blasted air and extends over the stacking location (2, 3), and an overlapping station (at least one of 9 and 10), which precedes the stacking location (2, 3) and has a deflecting member (30, 31) arranged above the conveying plane of the sheets and acting on the sheet ends in time with the sheet sequence, and a braking and conveying member (32, 33) arranged underneath the conveying plane of the sheet and acting on the deflected sheet ends, the improvement which comprises giving the overhead suspension arrangement (15) in the region of the stacking location (2, 3) an undulating profile running transverse to the conveying direction, the undulations being of sufficient height for stiffening the sheets against buckling when their front edges strike the front stop, the height of the undulating profile increasing from the rear stack edge to the stop (6) at the front stack edge.

2. Apparatus according to claim 1, characterized in that the height (h) of the undulation increases in stages.

3. Apparatus according to claim 1, characterized in that the overhead suspension arrangement (15) is formed by suspension bars (40,56) arranged adjacently and extending in conveying direction, the side of which facing the conveying plane is concavely or convexly curved.

4. Apparatus according to claim 1, characterized in that the overhead suspension arrangement (15) is formed by suspension bars arranged adjacently and extending in conveying direction, the flat sides of which facing the conveying plane are offset angularly with respect to one another to form the undulating profile.

5. Apparatus according to claim 1, characterized in that the braking member (32) is a rotating roller, which has an undulating profile corresponding to the undulating profile of the overhead suspension arrangement (15).

6. Apparatus according to claim 5, characterized in that the shaft (53) of the braking member (32) is fitted with brake discs (52) arranged at the same axial spacings apart as the shaft (34) with the brush segments (38) and in that suspension bars (54) of a suspension table fed with blasted air extend between the brake discs (52).

7. In an apparatus for the depositing of sheets at a stacking location (at least one of 2 and 3) which is provided with a stop (6) for the leading sheet edge, and which consists of conveying means (11, 12) having an overhead suspension arrangement (15), which is fed with blasted air and extends over the stacking location (2, 3), and an overlapping station (at least one of 9 and 10), which precedes the stacking location (2, 3) and has a deflecting member (30 ,31) arranged above the conveying plane of the sheets and acting on the sheet ends in time with the sheet sequence, and a braking and conveying member (32, 33) arranged underneath the conveying plane of the sheet and acting on the deflected sheet ends, the improvement which comprises giving the overhead suspension arrangement (15) in the region of the stacking location (2, 3) an undulating profile running transverse to the conveying direction, the undulations being of sufficient height for stiffening the sheets against buckling when their front edges strike the front stop, the apparatus further including a conveying member (33) arranged immediately ahead of the stacking location (2, 3), against which member the deflected sheet (50) is held by suction force, the conveying member (33) consisting of two rotating rollers (46, 47), of which the roller (47) lying in front in conveying direction lies immediately at the rear edge of the stack.

8. Apparatus according to claim 7, characterized in that the conveying member (33) is assigned a deflecting member (31), acting on the sheets in time with the sheet sequence, above the conveying plane of the sheets.

9. Apparatus according to claim 8, characterized in that the speed of the braking member (32) and of the conveying member (33) is dimensioned in relation to their spacing and the length of the sheets such that the sheet end of the one sheet (42) is retarded by the braking member (32) when the preceding sheet (50) leaves the conveying member (33).

10. Apparatus according to claim 7, characterized in that the rollers (46, 47) of the conveying member (33) consist of a plurality of small roller pieces arranged in a suction box (33) which are coupled to one another in alignment.

* * * * *